US006314259B1

(12) United States Patent
Chang et al.

(10) Patent No.: US 6,314,259 B1
(45) Date of Patent: Nov. 6, 2001

(54) PHOTORECEPTOR WEB FOR LIQUID ELECTROPHOTOGRAPHIC PRINTER

(75) Inventors: Kee-son Chang; Jin-geun Kwak, both of Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/588,555

(22) Filed: Jun. 7, 2000

(30) Foreign Application Priority Data

Oct. 27, 1999 (KR) ..... 99-46899

(51) Int. Cl.[7] ..... G03G 15/10

(52) U.S. Cl. ..... 399/237; 399/159; 399/162; 399/348

(58) Field of Search ..... 399/237, 116, 399/159, 160, 162, 239, 249, 278, 288, 348, 352; 346/136

(56) References Cited

U.S. PATENT DOCUMENTS

| | | | | |
|---|---|---|---|---|
| 4,400,083 | | 8/1983 | Beisty et al. | 399/99 |
| 4,636,787 | * | 1/1987 | Kishi | 346/136 |
| 5,229,813 | | 7/1993 | Cherian | 399/164 |
| 5,557,377 | | 9/1996 | Loewen et al. | 399/182 |
| 5,966,573 | * | 10/1999 | Yu et al. | 399/160 |
| 6,055,397 | | 4/2000 | Lee | 399/165 |
| 6,085,054 | * | 7/2000 | Kusayanagi | 399/249 |

* cited by examiner

*Primary Examiner*—Sophia S. Chen
*Assistant Examiner*—Hoan Tran
(74) *Attorney, Agent, or Firm*—Robert E. Bushnell, Esq.

(57) ABSTRACT

A photoreceptor web for a liquid electrophotographic printer on which a predetermined image is developed at a development unit and the developed image is transferred to a transfer unit to be printed on a sheet of paper, in which a total length of the photoreceptor web is 32±0.25 inches. The total length of the photoreceptor web is set to include a plurality of image zones in which an image to be printed on a sheet of paper is developed, an interval zone provided between the image zones as allowance zone, a drip line removing zone provided to avoid frictional contact with a squeegee roller of the development unit when the drip line is removed, a seam portion formed by combining both end portions of the photoreceptor web for forming a closed path, and a mark zone where a mark for detecting the seam portion is provided. Thus, the photoreceptor web does not occupy excess installation space in the printer and development, transfer and drip line removing operations are performed smoothly.

27 Claims, 3 Drawing Sheets

PHOTORECEPTOR WEB FOR LIQUID ELECTROPHOTOGRAPHIC PRINTER

CLAIM OF PRIORITY

This application makes reference to, incorporates the same herein, and claims all benefits accruing under 35 U.S.C. §119 from an application entitled A Photoreceptor Belt for Liquid Electrophotographic Printer earlier filed in the Korean Industrial Property Office on Oct. 27, 1999, and there duly assigned Ser. No. 99-46899 by that Office.

BACKGROUND OF THE INVENTION

1. Field of the Invention

The present invention relates to a liquid electrophotographic printer and, more particularly, to a photoreceptor web for a liquid electrophotographic printer that is a medium on which an image is developed and the developed image is printed on a sheet of paper.

2. Description of the Related Art

An electrophotographic printer makes a photographic recording of an image formed by the alteration in electrical properties of the sensitive materials, induced by the action of light. An example of a typical electrophotographic printer is a color laser printer. The color laser printer uses a laser beam to reproduce images or text on a photosensitive medium such as a photosensitive belt to which toner is applied. Where the light strikes the photosensitive belt, it will hold developer for transfer to a sheet of paper.

A color laser printer will include a photoreceptor web, a development unit, and a transfer unit. A laser scanner unit forms an electrostatic latent image by scanning a laser beam onto the photoreceptor web. Multiple rollers circulates the photoreceptor web, while a development unit develops the image to be printed on a transfer surface of the photoreceptor web. The developed image on the photoreceptor web is transferred to the paper when it passes the transfer unit.

In the development and transfer process, the photoreceptor web has an image zone where an image is developed and an interval zone between one image zone and the next image zone. The photoreceptor web has some excess developer that is commonly called a drip line. The drip line is periodically wiped off to allow for a clear print on paper.

Therefore, in manufacturing a photoreceptor web, factors such as the image zone, the interval zone, and the area for a drip line removing operation should be taken into consideration. For example, a lengthy photoreceptor web increases the cost and takes more space in the printer. Hence, a photoreceptor web having an optimized length, which does not need a large installation space in the printer and also guarantees that all the above operations are performed smoothly, is needed.

Exemplars of the art, U.S. Pat. No. 5,557,377 for Single Pass, In-line Color Electrophotographic Printer with Interspersed Erase Device issued to Loewen, et al., U.S. Pat. No. 6,055,397 for Photoreceptor Web Steering Apparatus for Printer issued to Lee, U.S. Pat. No. 5,229,813 for Composite Backup Roller Assembly issued to Cherian, U.S. Pat. No. 4,400,083 for Electrostatic Printer Drum Improvements issued to Beisty, et al. disclose liquid electrophotographic color printers. I have found that the background art does not teach an optimized length of the photoreceptor web.

SUMMARY OF THE INVENTION

To solve the above problems, it is an objective of the present invention to provide a photoreceptor web for a liquid electrophotographic printer having an optimized length that does not require a large installation space in the printer and enables smooth performance of development, transfer, and drip line removing operations.

It is another object to reduce the cost of manufacturing of an electrophotographic printerby modifying the photoreceptor web.

It is yet another object to have a more efficient printing process on an electrophotographic printer.

It is a further object to have an electrophotographic printer such as a color laser printer that optimizes the size and efficiency of a photoreceptor web by adjusting the image zone, the interval zone, and the area for a drip line removal operation.

Accordingly, to achieve the above objectives, there is provided a photoreceptor web for a liquid electrophotographic printer on which a predetermined image is developed at a development unit and the developed image is transferred to a transfer unit to be printed on a sheet of paper, where a total length of the photoreceptor web is 32±0.25 inches.

The total length of the photoreceptor web is set to include multiple image zones in which an image to be printed on a sheet of paper is developed, an interval zone provided between the image zones as an allowance zone, a drip line removing zone provide to avoid frictional contact with a squeegee roller of the development unit when the drip line is removed, a seam portion formed by combining both end portions of the photoreceptor web for forming a closed path, and a mark zone where a mark for detecting the seam portion is provided.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
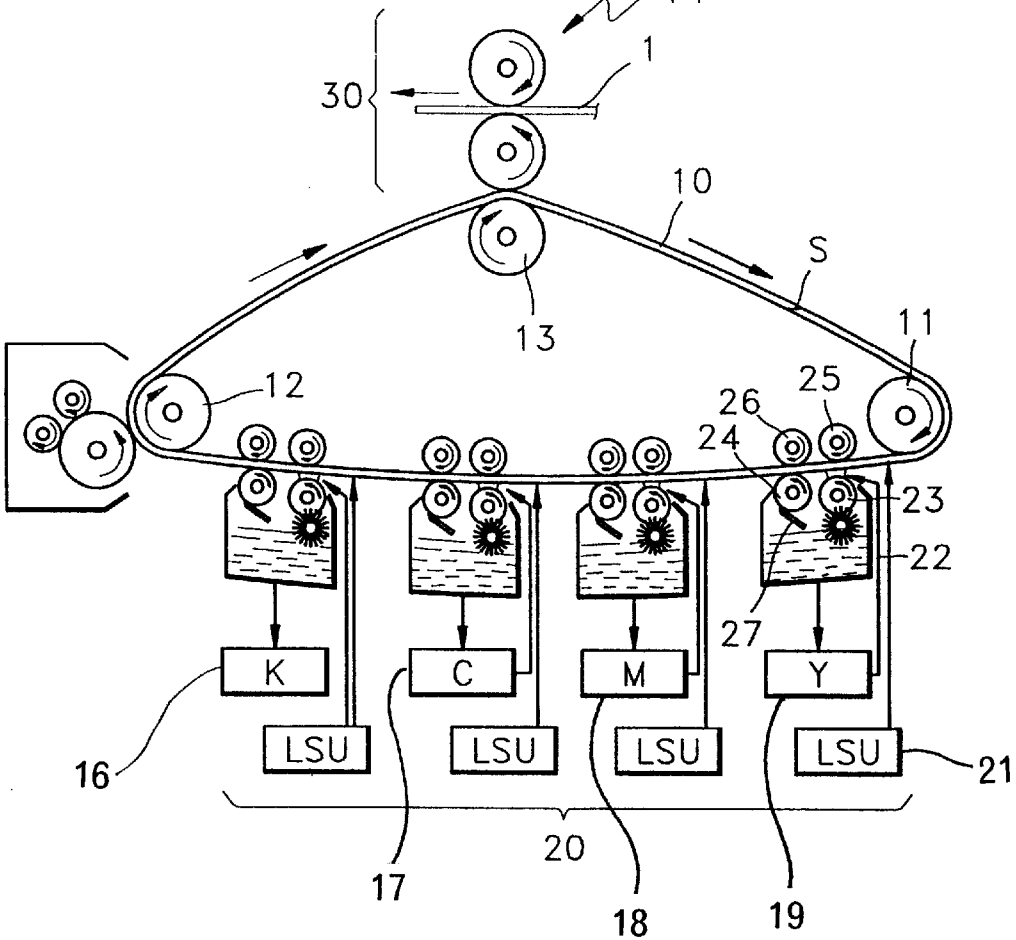
FIG. 1 is a view showing the structure of a liquid electrophotographic printer.

Turning now to the drawings, as shown in FIG. 1, a liquid electrophotographic printer 14 such as a color laser printer includes a photoreceptor web 10 circulating through the support of a plurality of rollers 11, 12 and 13, a development unit 20 for developing a predetermined image formed on the photoreceptor web 10, and a transfer unit 30 for transferring an image developed on the photoreceptor web 10 to a sheet of paper 1. The development unit 20 is for developing an image to be printed on a transfer surface of the photoreceptor web 10 using a developer, and includes a laser scanner 21 for forming an electrostatic latent image of a desired image by scanning a laser beam onto the photoreceptor web 10, a development roller 23 for developing the electrostatic latent image by forming a development film between the photoreceptor web 10 and itself with developer supplied through a supply line 22, and a squeegee roller 24 for removing excess developer that is not used for development by pressing the photoreceptor web 10. The electrophotographic printer includes toners such as black (K) 16, cyan (C) 17, magenta (M) 18, and yellow (Y) 19. Thus, during printing, the image on the photoreceptor web 10 is developed at the development unit 20 and the developed image is transferred to the paper 1 while it passes the transfer unit 30. Here, the development unit 20 and the squeegee roller 24 still wipe excess developer by pressing the photoreceptor web 10. Reference numeral 25 denotes a development backup roller and reference numeral 26 denotes a squeegee backup roller installed to face the squeegee roller 24 with the photoreceptor web 10 interposed there between for supporting a pressing force by the squeegee roller 24.

Figure 2:
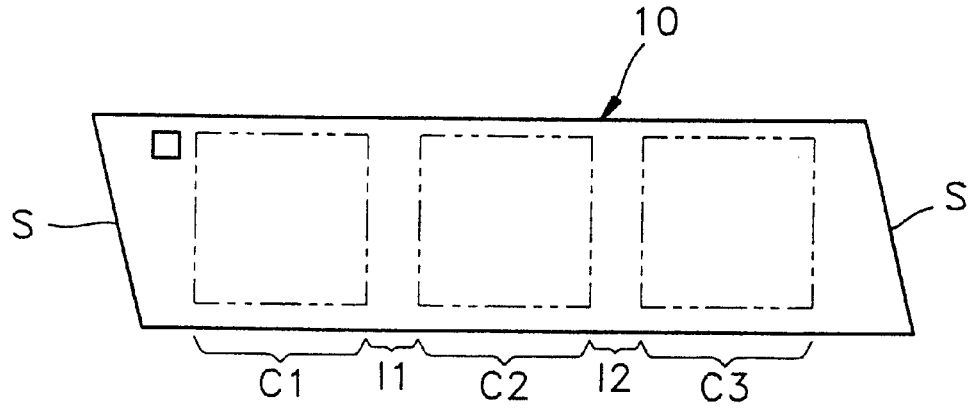
FIG. 2 is a view showing the photoreceptor web shown in FIG. 1.

Thus, to perform the development and transfer processes, the photoreceptor web 10 needs an image zone where an image is developed and an interval zone between one image zone and the next image zone. FIG. 2 shows the structure of the photoreceptor web 10 having image zones C1, C2 and C3 and interval zones I1 and I2. Preferably, for continuous printing, the photoreceptor web 10 develops images equivalent to at least three pages for each rotation. Accordingly, the three image zones C1, C2 and C3 and the two interval zones I1 and I2 there between are needed, as shown in the drawing. Reference character S denotes a seam portion where both end portions of the photoreceptor web 10 are connected to form a closed path.

Figure 3:
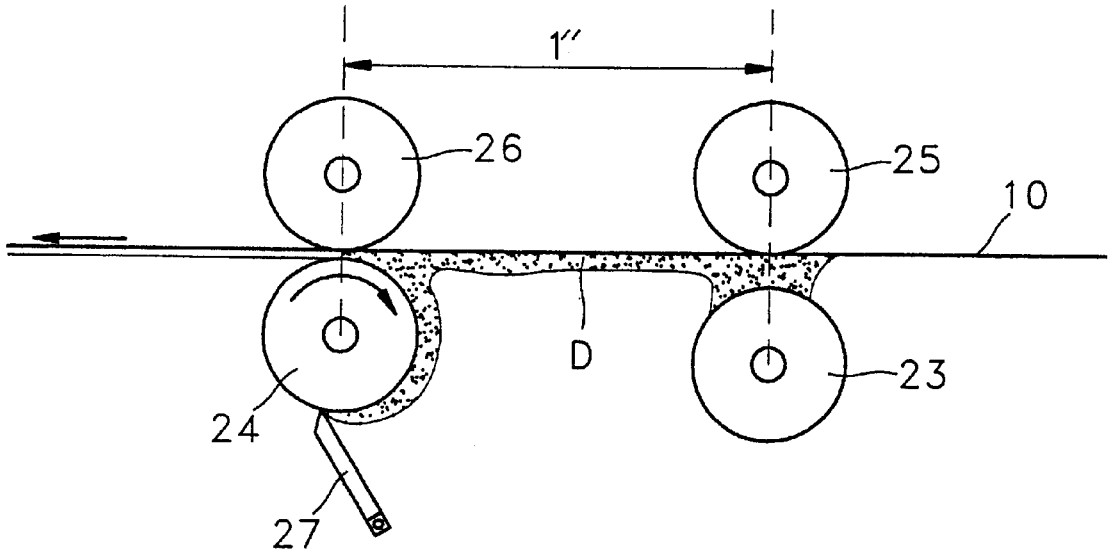
FIG. 3 is a view for explaining a drip line removing operation of the liquid electrophotographic printer.

When printing is completed, developer remains on a portion of the photoreceptor web 10 between the development roller 23 and the squeegee roller 24, as shown in FIG. 3. The remaining developer is commonly referred to as a drip line D and the drip line D must be removed periodically whenever printing is completed to guarantee that a clear image can be continuously developed. To remove the drip line D, when printing is completed, the squeegee roller 24 is rotated in a reverse direction, that is, clockwise on the drawing sheet. Reference numeral 27 denotes a blade that contacts the squeegee roller 24 closely and makes the developer flowing along the outer circumferential surface of the squeegee roller 24 drop downward to remove the drip line D. Thus, when printing is completed, the circulation speed of the photoreceptor web 30 is reduced and the squeegee roller 24 is slightly lowered to reduce the pressing force applied to the photoreceptor web 10. Then, the squeegee roller 24 is rotated in a reverse direction so that the drip line D formed between the photoreceptor web 10 and the squeegee roller 24 is removed. Preferably, the drip line removing operation is performed near the seam portion S. The operation of wiping the drip line is preferably performed around the seam portion S because the seam portion S corresponds to a non-image portion where no image can be developed. Further, damage may be caused to the surface of the photoreceptor web 10 because the drip line removing operation generates friction as the photoreceptor web 10 and the squeegee roller 24 are driven in directions opposite to each other. Therefore, the operation is preferably performed around the seam portion S because it is the least useful area of the photoreceptor web 10.

Figure 4:
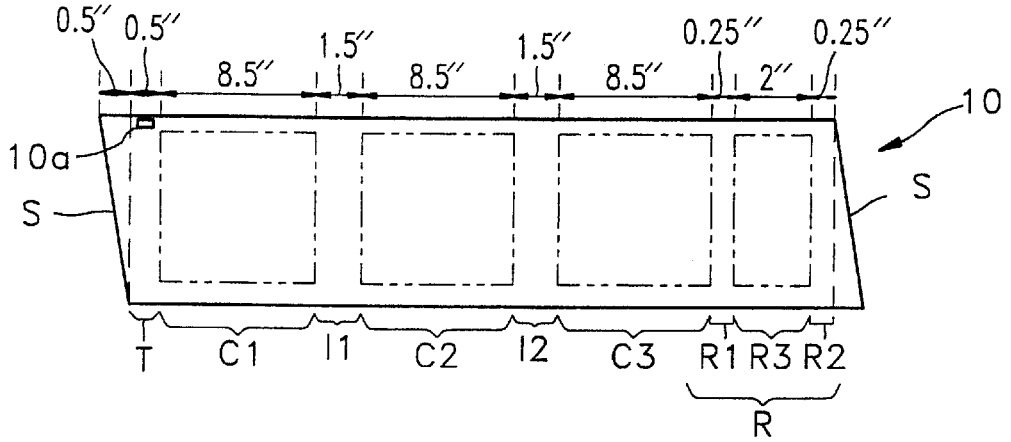
FIG. 4 is a view showing an unfolded photoreceptor web according to the present invention.

FIG. 4 shows an unfolded photoreceptor web according to the present invention. The photoreceptor web is actually installed at a printer in a state in which the seam portion S at both ends of the photoreceptor web are connected forming a closed path.

Referring to the drawing, there are three places for image zones C1, C2 and C3 where an image to be printed on a sheet of paper is developed. Setting three places for the image zones C1, C2 and C3 allows for the managing of a smooth continuous printing. As mentioned above, smooth continuous printing is possible when the amount of images that can be developed per rotation of the photoreceptor web 10 is equivalent to at least three sheets of paper. As the size of each of the image zones C1, C2 and C3, a standard of a letter-sized page of 8.5 inches×11 inches can be used along with an A4 sized (210 mm×297 mm) paper. As the short side of the paper is arranged to match the lengthwise direction of the photoreceptor web 10, images of an A4 size page can be included in the image zones C1, C2 and C3 in the same manner as the standard letter-sized paper. Thus, 25.5 inches corresponding to 8.5 inches×3 places is needed for the image zones C1, C2 and C3.

Next, there must be interval zones I1 and I2 as an allowance space between the respective image zones C1, C2 and C3. The interval zones I1 and I2 are needed for a delay time for performing picking up, transfer and arrangement of each sheet of paper because the paper for printing is not continuously supplied to the transfer unit 20 (see FIG. 1). In a typical liquid electrophotographic printer, a delay time of 0.4 second is generated for arranging the next sheet of paper after one sheet of paper is printed and putting it to the transfer unit 20. As the photoreceptor web 10 circulates at a speed of 3.0 inches per second in a print mode, allowance of 1.2 inches at the minimum is needed considering the delay time of 0.4 second. Also, considering a slight error to the above, a total of 1.5 inches is needed for the allowance. Thus, the interval zones I1 and I2 between the image zones C1, C2 and C3 except for an area for the seam portion S take 3 inches (1.5 inches×2 places).

The interval zone between the image zones C3 and C1, having the seam portion S, includes a zone R where the drip line removing operation is performed. Zone R is set different from the other interval zones I1 and I2. First, to perform the drip line removing operation, the rotation direction of the squeegee roller 24 (see FIG. 1) must be reversed. Smooth driving of the squeegee roller 24 in the reverse direction is possible by reducing the pressing force applied to the photoreceptor web 10 in advance. When the drip line is removed, the speed of the photoreceptor web 10 is decelerated to 0.75 inches per second from 3 inches per second. Thus, a time of about 0.2 second is needed for the above speed and pressure reduction after passing the image zones C1, C2 and C3. Here, 0.32 second is needed considering a safety rate of 1.6, during which the photoreceptor web 10 circulating at a speed of 0.75 inches per second travels as much as about 0.25 inches. Thus, a first preparation zone R1 of 0.25 inches is needed to be set prior to the drip line removing operation.

Next, in an operation zone R3 where the drip line removing operation is actually performed, the distance between the development roller 23 and the squeegee roller 24 where a drip line is formed is one inch, as shown in FIG. 3. In this one inch, developer of about 1.6 milliliters forms a drip line D. Thus, to remove the drip line, the squeegee roller 24 is rotated in a reverse direction in a state in which the photoreceptor web 10 circulates. Basically, an absolute distance of one inch must be traveled to remove the drip line formed between the development roller 23 and the squeegee roller 24 as it passes the squeegee roller 24. After traveling a distance of one inch, the squeegee roller 24 is further rotated three turns more so that the remaining developer adhering to the squeegee roller 24 is completed removed. According to experiments, however, during the drip line removing operation, the squeegee roller 24 must be rotated in reverse at a relative speed of 9 inches per second with respect to the photoreceptor web 10 to effectively remove the drip line. Thus, when the speed of the photoreceptor web 10 is 0.75 inches per second, the squeegee roller 24 must be rotated at 9.25 inches per second in a reverse direction to effectively remove the drip line D. The linear speed of 8.25 inches per second corresponds to a rotational speed of about three turns per second considering that the diameter of the squeegee roller 24 is 22 mm (0.87 inches). As a result, about one second is needed to rotate the squeegee roller 24 three turns and the photoreceptor web 10 circulating at a speed of 0.75 inches per second travels 0.75 inches for that period, so that a distance of about one inch is needed. Thus, by adding the one inch to the absolute distance of one inch between the development roller 23 and the squeegee roller 24, a total of 2 inches of the operation zone R3 is needed.

Next, after the drip line D is removed, the squeegee roller 24 is separated from the photoreceptor web 10 before contacting the seam portion S. Here, about 0.2 second is needed as the time for preparation. Thus, considering the safety rate of 1.6, a second preparation zone R2 of about 0.25 inches which is a distance of movement at a speed of 0.75 inches per second for 0.32 second is needed. Thus, the overall drip line removing zone R take 2.5 inches which is the sum of the first and second preparation zones R1 and R2 and the operation zone R3.

The seam portion S is usually formed to be inclined with a width of 0.5 inches. After the seam portion S, a mark zone T of 0.5 inches before the image zones C1, C2 and C3, in which a TOF (top of forming or form) 10*a* is formed. TOF is a mark for detecting the position of the seam S.

Consequently, considering all necessary zones, a total of 32 inches are needed, including 25.5 inches for three 8.5-inch places of the image zones C1, C2 and C3, inches for two 1.5-inch places for the interval zones I1 and 12 between the image zones C1, C2 and C3 that are not crossing the seam portion S, 2.5 inches for the drip line removing zone R consisting of two 0.25 inches for the first and second preparation zones R1 and R2 and 2 inches for the operation zone R3, 0.5 inches for the seam portion S, and 0.5 inches for the mark zone T.

Thus, a photoreceptor web having a length of 32 inches is the optimal size as it does not take excessive installation space in a printer and simultaneously smooth development, transfer and drip line removing operations are performed. Also, as one inch instead of 0.75 inches is taken into consideration when the operation zone R3 of the drip line removing zone R is calculated, a margin of at least 0.25 inches is included. Therefore, a range of allowance of about ±0.25 inches is allowed with respect to 32 inches. 32 inches being the accurate length of the photoreceptor web.

Figure 5:
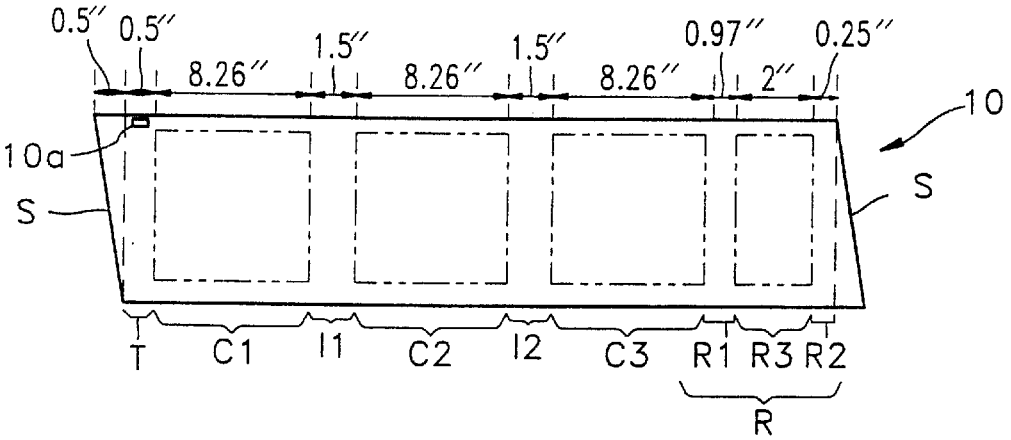
FIGS. 5 and 6 are views showing the photoreceptor web shown in FIG. 4 corresponding to various paper sizes.

Although the photoreceptor web 10 is manufactured based on a letter-sized page, for example, sheets of paper of A4 size (210 mm×297 mm or 8.26 inches×11.69 inches) can be used with no problem, as shown in FIG. 5. That is, as the length of the short side of an A4 size paper is 8.26 inches (210 mm), when three image zones are to be set, a total of 0.72 inches is left compared to a case of a letter size paper having a short side length of 8.5 inches. The leftover length is included in the first preparation zone R1 so that more allowance exists before the drip line begins to be removed.

Figure 6:
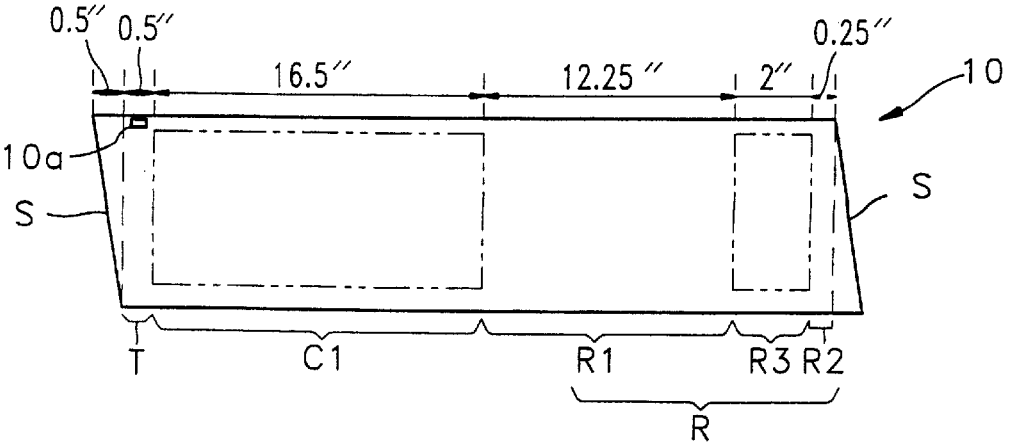

When sheets of paper of A3 size (297 mm×420 mm or 11.69 inches×16.5 inches) are used, the long side the A3 paper must be arranged in a lengthwise direction of the photoreceptor web, as shown in FIG. 6, because the paper goes beyond the width of the photoreceptor web if it is arranged in a widthwise direction of the A3 paper. Thus, only one image zone C1 is set in the 32 inch photoreceptor web 10. In this case, 12 inches are left including two interval zones compared to the letter size paper. Accordingly, the first preparation zone R1 is extended to 12.25 inches so that more sufficient allowance is provided prior to the drip line removing operation.

Thus, sheets of paper having different sizes can be used by increasing or decreasing the first preparation zone R1 or the second preparation zone R2.

As described above, in the photoreceptor web for a liquid electrophotographic printer according to the present invention, development, transfer and drip line removing operations are smoothly performed and also no excess installation space in the printer is needed.

What is claimed is:

1. A liquid electrophotographic printer, comprising:

a photoreceptor web circulating through a support of a plurality of rollers, said photoreceptor web having a predetermined total length, said photoreceptor web further comprising:

a first zone of said photoreceptor web having a developed image;

a second zone adjacent to said first zone accommodating a preparation of wiping a drip line on said photoreceptor web by a first roller, the drip line being excess developer remaining on said photoreceptor web, the drip line being periodically wiped off to allow a clear print on said printable medium;

a third zone adjacent to said second zone and being an area on said photoreceptor web accommodating the wiping of the drip line; and a fourth zone adjacent to said third zone and corresponding to where the first roller is separated from said photoreceptor web before contacting a seam portion of said photoreceptor web, the seam portion connecting said photoreceptor web in a continuous loop;

a development unit developing an image to be printed on a transfer surface of said photoreceptor web; and a transfer unit conveying the developed image from the photoreceptor web to a printable medium.

2. The printer of claim 1, with said first zone having a length according to a size of said printable medium.

3. The printer of claim 2, with said second zone having a length determined according to a time period from a start of deceleration of said photoreceptor web to a predetermined speed and until a reversing of direction of said first roller.

4. The printer of claim 3, with a length of said second zone extended by a difference between a length of the image on said photoreceptor web and a predetermined image length.

5. The printer of claim 4, with a length of said third zone being a sum of a first distance between said first roller and a second roller and a second distance determined according a predetermined number of rotations of said first roller, said second roller developing an electrostatic latent image by forming a development film between said photoreceptor web and said second roller with said developer.

6. The printer of claim 5, with a length of said fourth zone determined according to a duration of said first roller separating from said photoreceptor web before contacting said seam portion, the safety rate taken into account in determining the length of said fourth zone.

7. The printer of claim 1, with said second zone having a length between about 0.25 inches and about 12.25 inches.

8. The printer of claim 1, with said third zone having a length of about 2 inches.

9. The printer of claim 1, with said fourth zone having a length of about 0.25 inches.

10. The printer of claim 1, further comprising a fifth zone having a mark accommodating detection of said seam portion.

11. The printer of claim 1, further comprising three first zones, each first zone having a length of about 8.5 inches.

12. The printer of claim 11, further comprising two interval zones provided between said three first zones, said interval zones being about 1.5 inches long.

13. The printer of claim 1, further comprising an interval zone between one first zone and another first zone, said interval zone having a length determined according to a delay time accommodating arranging a next printable medium and placing said printable medium into said transfer unit.

14. A liquid electrophotographic printer, comprising:

a photoreceptor web circulating through a support of a plurality of rollers, said photoreceptor web having a predetermined total length according to a duration of removing excess developer from said photoreceptor web, said photoreceptor web having a total length from and including 31.75 inches to and including 32.25 inches;

a development unit developing an image to be printed on a transfer surface of said photoreceptor web; and a transfer unit conveying the developed image from the photoreceptor web to a printable medium.

15. The printer of claim 14, with said photoreceptor web having a predetermined number of images according to a size of said images accommodating a smooth printing on said printable medium.

16. A liquid electrophotographic printer, comprising:

a photoreceptor web circulating through a support of a plurality of rollers, said photoreceptor web having a predetermined total length according to a duration of removing excess developer from said photoreceptor web, said photoreceptor web having at least three images when length of an image does not exceed the width of said photoreceptor web, and said photoreceptor web having at least one image when the length of an image exceeds the width of said photoreceptor;

a development unit developing an image to be printed on a transfer surface of said photoreceptor web; and a transfer unit conveying the developed image from the photoreceptor web to a printable medium.

17. A photoreceptor web for a liquid electrophotographic printer, comprising said photoreceptor web having a predetermined image being developed at a development unit and the developed image being transferred to a transfer unit to be printed on a sheet of paper, a total length of said photoreceptor web being from and including 31.75 inches to and including 32.25 inches.

18. The photoreceptor web of claim 17, with the total length of said photoreceptor web including:

a plurality of image zones, each one of said image zones having an image developed to be printed on a sheet of paper;

an interval zone provided between said image zones as allowance of a delay of arranging a next sheet of paper, a drip line removing zone provided to avoid frictional contact with a squeegee roller of the development unit when the drip line is removed;

a seam portion formed by combining both end portions of said photoreceptor web for forming a closed path; and a mark zone having a mark detecting said seam portion.

19. The photoreceptor web of claim 18, further comprising three places each having a length of about 8.5 inches being provided as said image zones.

20. The photoreceptor web of claim 18, with said two interval zones being provided between said three image zones and each one being about 1.5 inches long.

21. The photoreceptor web of claim 18, with the drip line removing zone including an operation zone of 2 inches where a drip line removing operation is performed by the squeegee roller, a first preparation zone of about 0.25 inches being an allowance space provided between the image zone and the operation zone, and a second preparation zone of about 0.25 inches being an allowance space provided between said seam portion and the operation zone.

22. The photoreceptor web of claim 18, with said seam portion being about 0.5 inches long.

23. The photoreceptor web of claim 18, with said mark zone being about 0.5 inches long.

24. A method, comprising the steps of:

determining a length of a first zone of a photoreceptor web according to a size of a printable medium, said first zone having a developed image, said photoreceptor web circulating through a support of a plurality of rollers;

determining a length of a second zone adjacent to said first zone according to a time period from deceleration of said photoreceptor web to a predetermined speed and until a reversing of a direction of a first roller touching said photoreceptor web, and according to a safety rate of said photoreceptor web, the length of said second zone extended by a difference between a length of the image on said photoreceptor web and a predetermined image length, said second zone accommodating a preparation of wiping a drip line on said photoreceptor web by the first roller, the drip line being excess developer remaining on said photoreceptor web, the drip line being periodically wiped off to allow a clear print on said printable medium;

determining a length of a third zone adjacent to said second zone by a summing a first distance between said first roller and a second roller and a second distance determined according a predetermined number of rotations of said first roller, said second roller developing an electrostatic latent image by forming a development film between said photoreceptor web and said second roller with said developer, said third zone being an area on said photoreceptor web accommodating the wiping of the drip line;

determining a length of a fourth zone adjacent to said third zone according to a duration of said first roller separating from said photoreceptor web before contacting a seam portion, the safety rate taken into account in determining the length of said fourth zone, the seam portion connecting said photoreceptor web in a continuous loop; and determining a total length of said photoreceptor web by adding the lengths of said first, second, third, and fourth zones.

25. The method of claim 24, with said determining of the total length of said photoreceptor web further comprising the step of adding a fifth zone, an interval zone, and said seam portion, said fifth zone having a mark accommodating detection of the seam portion, said interval zone located between one first zone and another first zone, said interval zone having a length determined according to a delay time accommodating arranging a next printable medium and placing said printable medium into a transfer unit.

26. The method of claim 25, with said first zone having a length of at least about 8.26 inches, said second zone having a length between about 0.25 inches and about 12.25 inches, said third zone having a length of about 2 inches, said fourth zone having a length of about 0.25 inches, said fifth zone having a length of about 0.5 inches, said seam portion having a length of about 0.5 inches, and said interval zone having a length of about 1.5 inches.

27. The method of claim 24, with said total length of said photoreceptor web being from and including about 31.75 inches to and including about 32.25 inches.

* * * * *